US007654158B2

(12) United States Patent
Weems

(10) Patent No.: US 7,654,158 B2
(45) Date of Patent: Feb. 2, 2010

(54) REAL TIME TORQUE SYSTEM

(75) Inventor: Craig Currie Weems, Houston, TX (US)

(73) Assignee: Nabors Global Holdings Ltd., Hamilton (BM)

( * ) Notice: Subject to any disclaimer, the term of this patent is extended or adjusted under 35 U.S.C. 154(b) by 0 days.

(21) Appl. No.: 11/972,814

(22) Filed: Jan. 11, 2008

(65) Prior Publication Data

US 2008/0168827 A1 Jul. 17, 2008

Related U.S. Application Data

(60) Provisional application No. 60/884,711, filed on Jan. 12, 2007.

(51) Int. Cl.
*G01L 3/02* (2006.01)

(52) U.S. Cl. ..... 73/862.193; 73/862.08

(58) Field of Classification Search ..... 73/862.331–862.333, 193, 862.08
See application file for complete search history.

(56) References Cited

U.S. PATENT DOCUMENTS 4,224,821 A * 9/1980 Taylor et al. ..... 73/32 R
4,296,897 A * 10/1981 Thompson ..... 244/111
4,328,872 A * 5/1982 Orthwein ..... 173/160
4,625,559 A * 12/1986 Carter et al. ..... 73/706
5,831,173 A * 11/1998 Hanano ..... 73/831
6,938,464 B1 * 9/2005 Bi ..... 73/54.28

OTHER PUBLICATIONS

Tracy Cummins, "New Tool Makes Casing Drilling Faster" in E&P, Sep. 6, 2006, pp. 1-3.

* cited by examiner

*Primary Examiner*—Max Noori
(74) *Attorney, Agent, or Firm*—Haynes and Boone, LLP

(57) ABSTRACT

Apparatus and methods for measuring in-situ applied torque in tubular operations. A torque cylinder has a first end and a second end. A torque rod is at least partially contained in the torque cylinder and is coupled to the first end of the torque cylinder. The torque rod extends longitudinally outward from the second end of the torque cylinder. A strain gauge is connected to the torque rod at a predetermined distance from the first end of the torque cylinder. The strain gauge is configured to measure in-situ the applied torque between two tubular drill string segments each coupled to a respective one of the torque cylinder and the torque rod.

17 Claims, 16 Drawing Sheets

REAL TIME TORQUE SYSTEM

CROSS-REFERENCE TO RELATED APPLICATIONS

This application claims the benefit of the earlier filing date of U.S. Provisional Patent Application Ser. No. 60/884,711, filed on Jan. 12, 2007, entitled "Real Time Torque System," the disclosure of which is incorporated herein by reference in its entirety.

BACKGROUND

The exacting application of torque is a requirement during all phases of oilfield drilling and completion. In response, many vendors employ a variety of methods to apply calibrated rotary motion to achieve desired levels of torque. With respect to calibration in general, typically a device that measures a linear dimension is calibrated against a certified length standard, a pressure gauge against a calibrated pressure gauge, and so forth, where calibration may be defined as the process of adjusting the output or indication on a measurement instrument to agree with the value of the applied standard. Calibration standards, in turn, are similarly calibrated against even more precise standards and so on until the reference is a national standard. A chain of authority is created such that the lowest link can refer up through cascading standards to a singular standard.

The calibration process with respect to torque measurements is largely disregarded in oilfield applications. Torque measuring devices are not typically calibrated by the application of a known force. Instead, load cells are used to measure torque referentially (as opposed to directly), and these load cells are calibrated by the application of force with no involvement of torque. In the United States, torque is typically measured in the number of pounds applied to a one foot long moment arm. To better understand why torque measurement is subordinated, perhaps an examination of pressure measurement would be informative. Pressure standards, known as dead weight testers, directly generate calibrated loads in pounds per square inch (psi). The load is generated by the application of a known weight on a piston of known diameter. Knowing the weight and the cylinder diameter enables the accurate calculation of the hydrostatic load measured in psi. A hierarchy of dead weight standards of ever increasing accuracy culminating with the national standard are available as desired.

Unfortunately, torque measurements do not lead to such straightforward solutions. There are no recognized national torque standards. Thus, torque measurements are made by indirect reference. Typically, oilfield processes measure torque referentially by the torque reaction of a measured reaction arm against a calibrated pressure sensor or mathematically by the application of a measured amount of electrical energy to a motor attached to a gearbox with a known gear reduction. Too often these referential torque measurements are made far away from the object of interest, in particular oilfield tubular connections. These tubular connections have precise torque requirements and often specify torque tolerances of only 10% away from nominal. Despite the best efforts of service providers, torque measurements often have significant errors, far exceeding the 10% allowance specified by connection suppliers.

In oilfield environments, electronic load cells are most often the source of data, and as such are frequently calibrated to 1% accuracy, for which there is no dispute with respect to the calibration method. The installation of load cells, however, is open to substantial criticism. The moment arm in this case is measured with a tape measure by identifying the center of rotation of a tong to the clevis attached to the tong. The snub line attached to the tong is either to be 90° from tong body or of a known angle. So far, it is easy to imagine a variety of errors that can affect the torque measurement, including arm length errors and snub line angle errors (in two planes).

Even assuming all the measurements are precise, yet another more insidious error is introduced: unknown, asymmetric, and spurious parasitic torque losses developed by the tong. Despite the best efforts of measuring the reaction torque of the tong body, the measurements do not quantify the actual torque applied to the connection of interest. In this case, only the application of torque by the use of a pipe tong is examined. Known methods of torque application suffer significant errors in torque measurement through faulty mechanics, such that these measurements suffer significant parasitic torque losses, the errors are not symmetric, and ultimately the torque measured has only a distant relationship with the torque applied.

Thus, there exists a need for a device that can measure torque in-situ regardless of its physical orientation.

DETAILED DESCRIPTION

Figure 1:
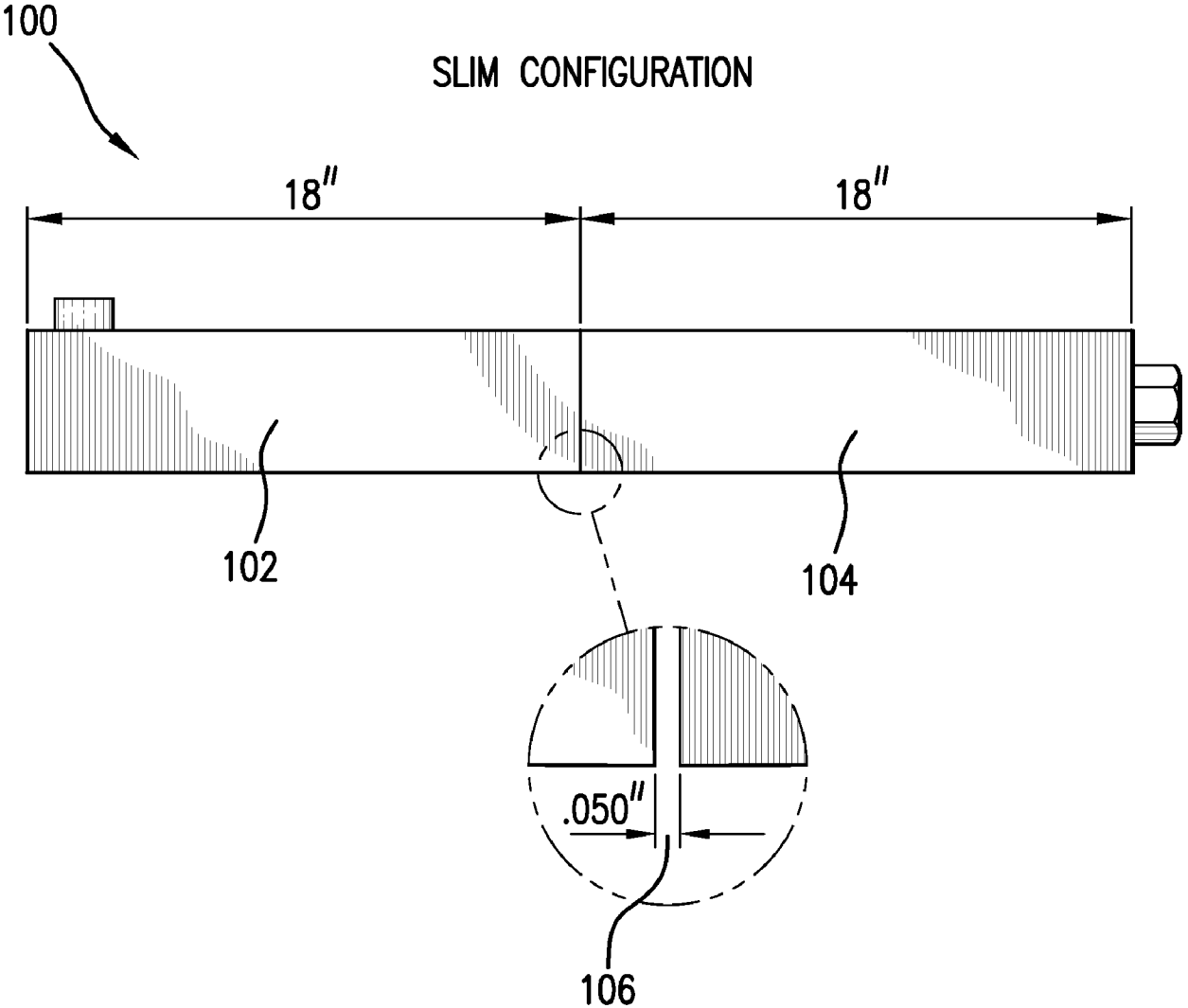
FIG. 1 is a side view of the apparatus according to one or more aspects of the present disclosure.

Certain terms are used throughout the following description and claims to refer to particular apparatus components. This document does not intend to distinguish between components that differ in name but not function. In the following discussion and in the claims, the terms "including" and "comprising" are used in an open-ended fashion, and thus should be interpreted to mean "including, but not limited to . . . ."

Various embodiments of a torque measuring device, referred to herein as a real time torque system, that can be used to measure torque in-situ will now be described with reference to the accompanying drawings, wherein like reference numerals are used for like features throughout the several views. There are shown in the drawings, and herein will be described in detail, specific embodiments of the real time torque system with the understanding that this disclosure is representative only and is not intended to limit the present disclosure to those embodiments illustrated and described herein. The embodiments of the real time torque system and methods of use disclosed herein may be used to measure torque in-situ in any system, operation, or process where torque is applied, including but not limited to land and offshore oil and gas rigs. It is to be fully recognized that the different teachings of the embodiments disclosed herein may be employed separately or in any suitable combination to produce desired results.

The present disclosure relates generally to torque measurement. More particularly, the present disclosure relates to a torque measuring device, referred to herein as a real time torque system, that can be used to measure torque in-situ regardless of the orientation of the real time torque system.

The Real Time Torque System (RTTS) is a calibration tool for in-situ torque measurement in oilfield environments. It is the object of the RTTS to directly measure applied torque with instruments that are calibrated with an applied torque. The tool can utilize a number of technologies to measure torque, including electronic, hydraulic, and pneumatic (henceforth known as load cells). The load cells can be configured to measure torque directly by the use of reaction arms or through the translation of rotary motion into axial motion.

In operation, an RTTS tool will be chosen so that its measurement output will be compatible with the resident torque measurement equipment. This communication may be entered manually such that constant loads would be applied and the measurement differences recorded. This process would be repeated until corrected data is available over the expected torque range of the equipment in use. This calibration mapping process could be performed programmatically such that the device being calibrated could use the calibrated data to remap its own output. Moreover, this calibration method will be tested at varying intervals to confirm the stability of the calibrated tool. Such confirmation calibration may be done at only a few intervals in the interest of time and without substantially diminishing the accuracy of the process.

In operation, the RTTS will be used to calibrate the measurement systems of torque application equipment. This calibration can be a simple establishment of measurement offset and slope to granular torque maps. Once calibrated, it is expected that the recalibrated torque devices will remain consistent over specified periods of time determined empirically. The RTTS can also be used in tandem with the torque device such that the RTTS can serve as continual torque reference. Communication with the RTTS can be through a variety of technologies including wired and wireless methods. The wireless methods can include radio frequency and infrared transport.

The time required for such conforming calibration is expected to take less than 5 minutes and in any case will be performed every 6 hours. The actual impact on rig operations, for example, will be minimal as often rig operations are interrupted and during these times tool calibration may be performed in parallel with other activities without any loss of productive time.

Referring to FIG. 1, illustrated is an exemplary embodiment of an RTTS tool 100 that measures applied torque in-situ between upper and lower oilfield tubular members. The RTTS tool 100 may comprise a cylindrically-shaped torque rod 102 and torque cylinder 104 combination. In other embodiments, the torque rod 102 may comprise other shapes. The torque rod 102 and torque cylinder 104 may be separated by a gap 106, such as may be configured to permit opposing axial rotation between the torque rod 102 and torque cylinder 102, among other possible purposes.

Figure 2:
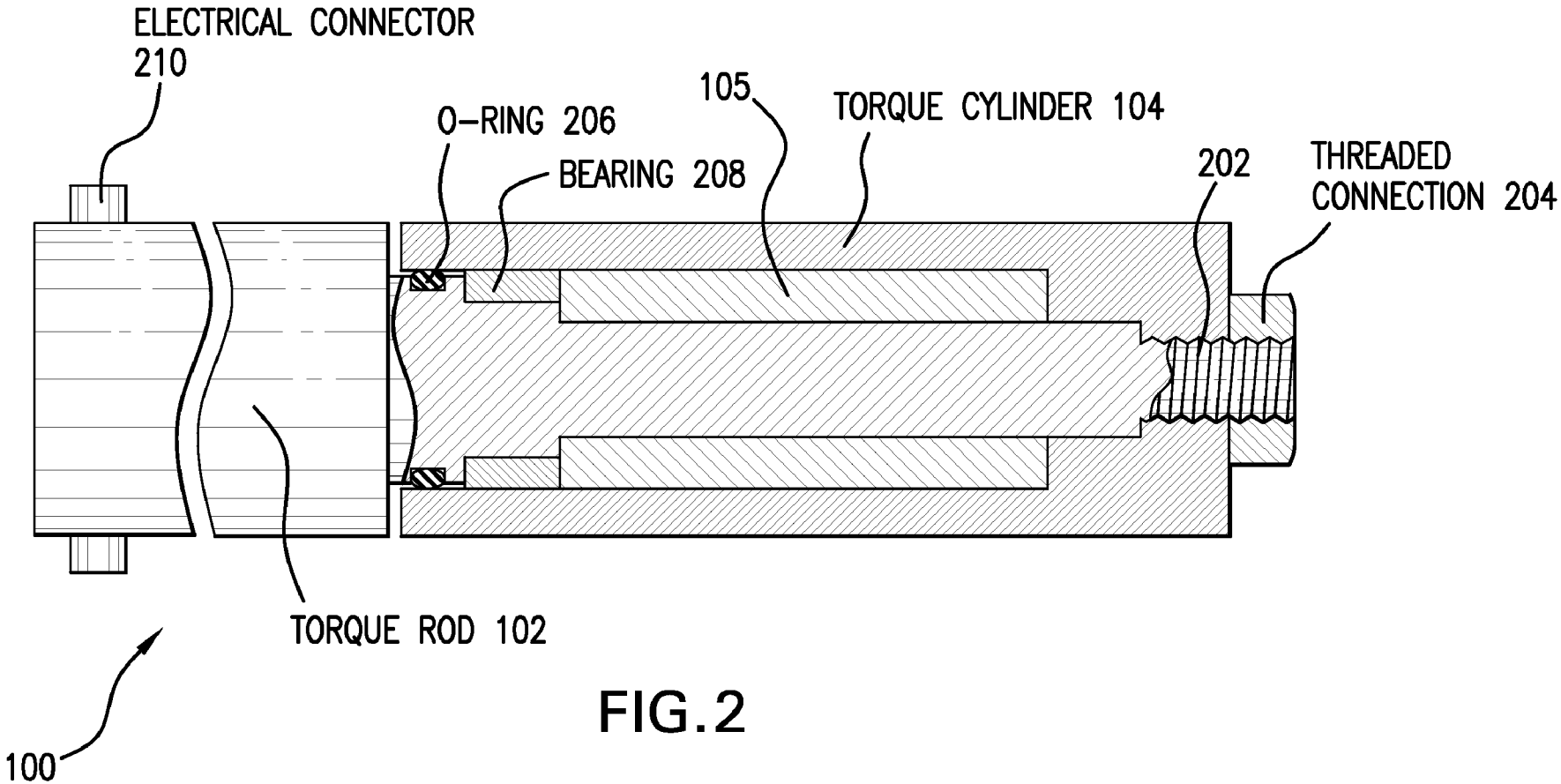
FIG. 2 is a cross-sectional view of a portion of the apparatus shown in FIG. 1.

As depicted in FIG. 2, the torque rod 102 may extend the length of the RTTS tool 100, and is partly contained by the torque cylinder 104. In an exemplary embodiment, the torque rod 102 may be coupled to the torque cylinder 104 by means of a threaded member 202 and nut 204 assembly (shown in further detail in FIGS. 3 and 4). The RTTS tool 100 may also comprise an O-ring 206 and a bearing 208 that are interposed between the torque rod 102 and the torque cylinder 104. The O-ring 206 may function to maintain the RTTS tool 100 intact by preventing the torque rod 102 from slipping out of the torque cylinder 104, and may also prevent the passage of fluids into the cavity 105 defined between the torque rod 102 and torque cylinder 104. The bearing 208 may serve to permit constrained relative motion (i.e., opposite, axial rotation) between the torque rod 102 and the torque cylinder 104. In one embodiment, the bearing may be made of a malleable material, like bronze, to reduce torque rod 102 wear over time.

Also illustrated in FIG. 2 is an electrical connector 210 that may be coupled to the outer structure of the torque rod 102 and may be used for transmission of data measured by the RTTS tool 100. In an exemplary embodiment, the RTTS 100 produces an output which may be viewed by a drilling operator or his representative in substantially real time, i.e., the drilling operator is able to view an output while a tubular connection is made-up, and is practically able to determine, during or at the conclusion of the make-up operation, that the required torque has been achieved.

Figure 3:
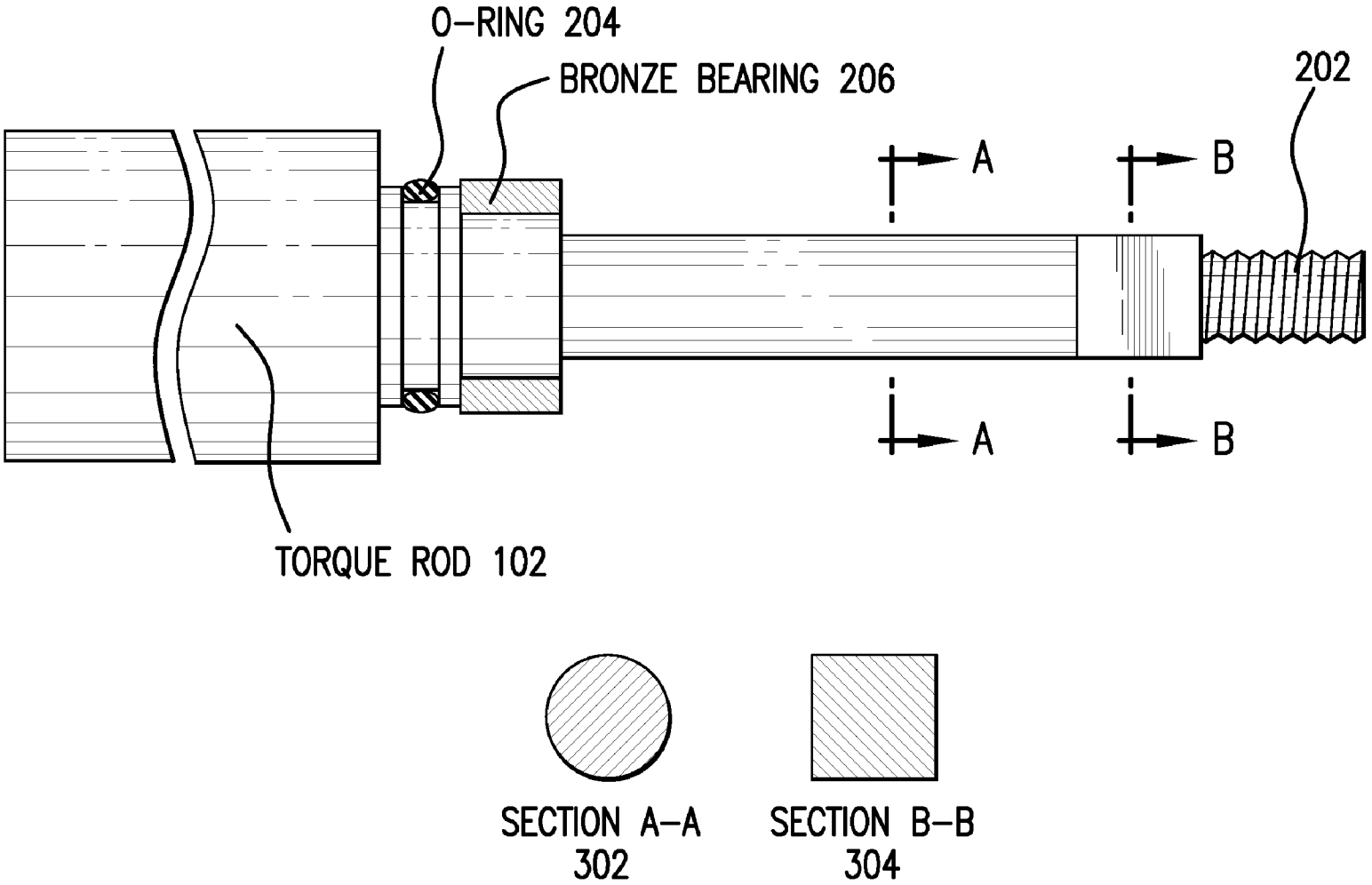
FIG. 3 is a side view of a portion of the apparatus shown in FIG. 2.
Figure 4:
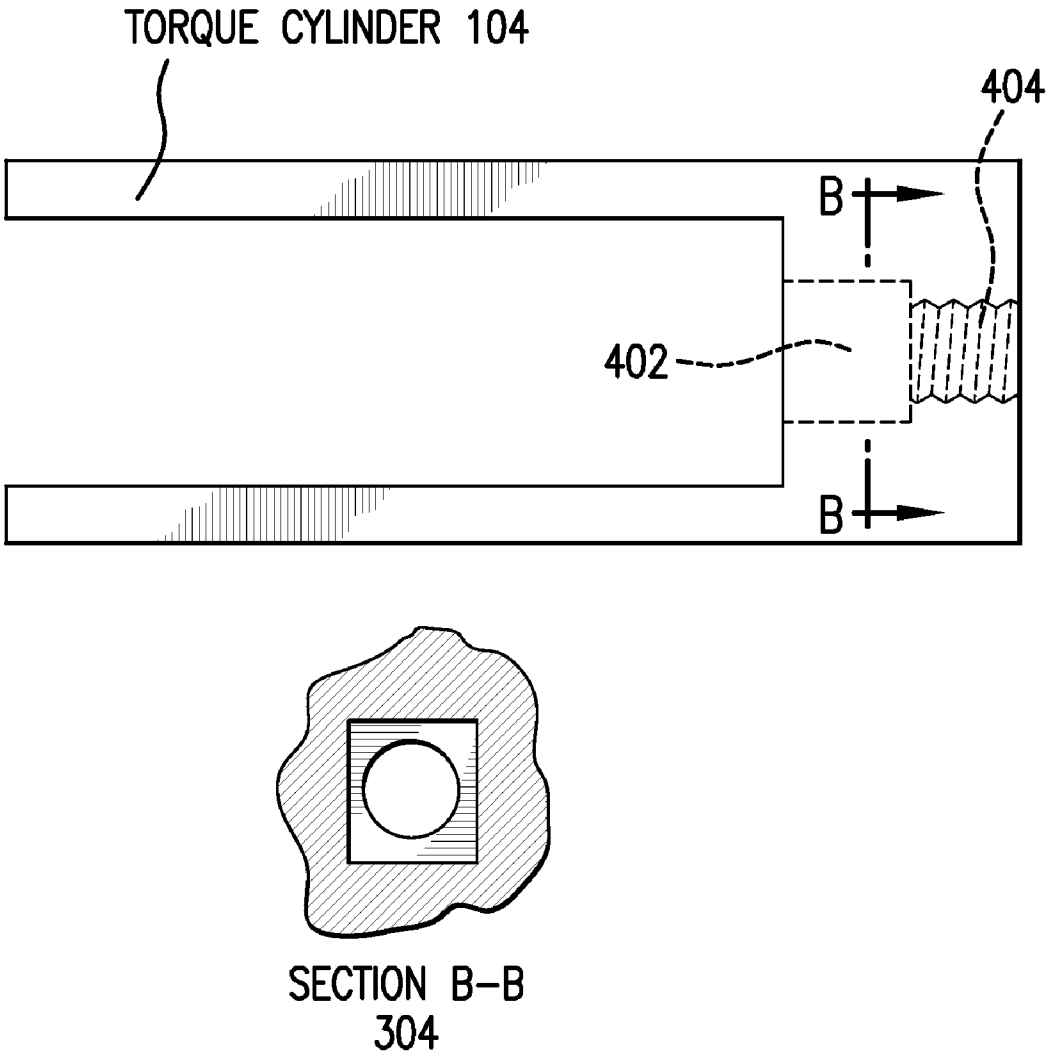
FIG. 4 is a side view of a portion of the apparatus shown in FIG. 2.

Referring to FIGS. 3 and 4, illustrated is an exemplary embodiment of how the torque rod 102 may be coupled to the torque cylinder 104. The shaft of the torque rod 102 may be cylindrical, as depicted in cross section A-A 302. The end of the torque rod 102, however, may be square-shaped as depicted by cross section B-B 304, and may further comprise a threaded member 202 extending longitudinally outwardly. The square-shaped end 304 may be configured to seat in an aperture 402 of the torque cylinder 104, while the threaded member 202 extends through the aperture 404 thus exposing enough threads to allow the nut 204 to be threaded (see FIG. 2). Seating the square-shaped portion 304 in aperture 402 prohibits the axial rotation of the torque rod 102, thus allowing the measurement devices (e.g., strain gauges) coupled to the torque rod 102 to accurately interpret the applied torque. In an alternative embodiment, the square-shaped end 304 may define a threaded orifice that is configured to match an adjacently threaded aperture 404 through which a threaded bolt may be introduced from outside the torque cylinder 104. Other means for coupling the torque rod 102 and the torque cylinder 104 are also within the scope of the present disclosure.

Figure 5:
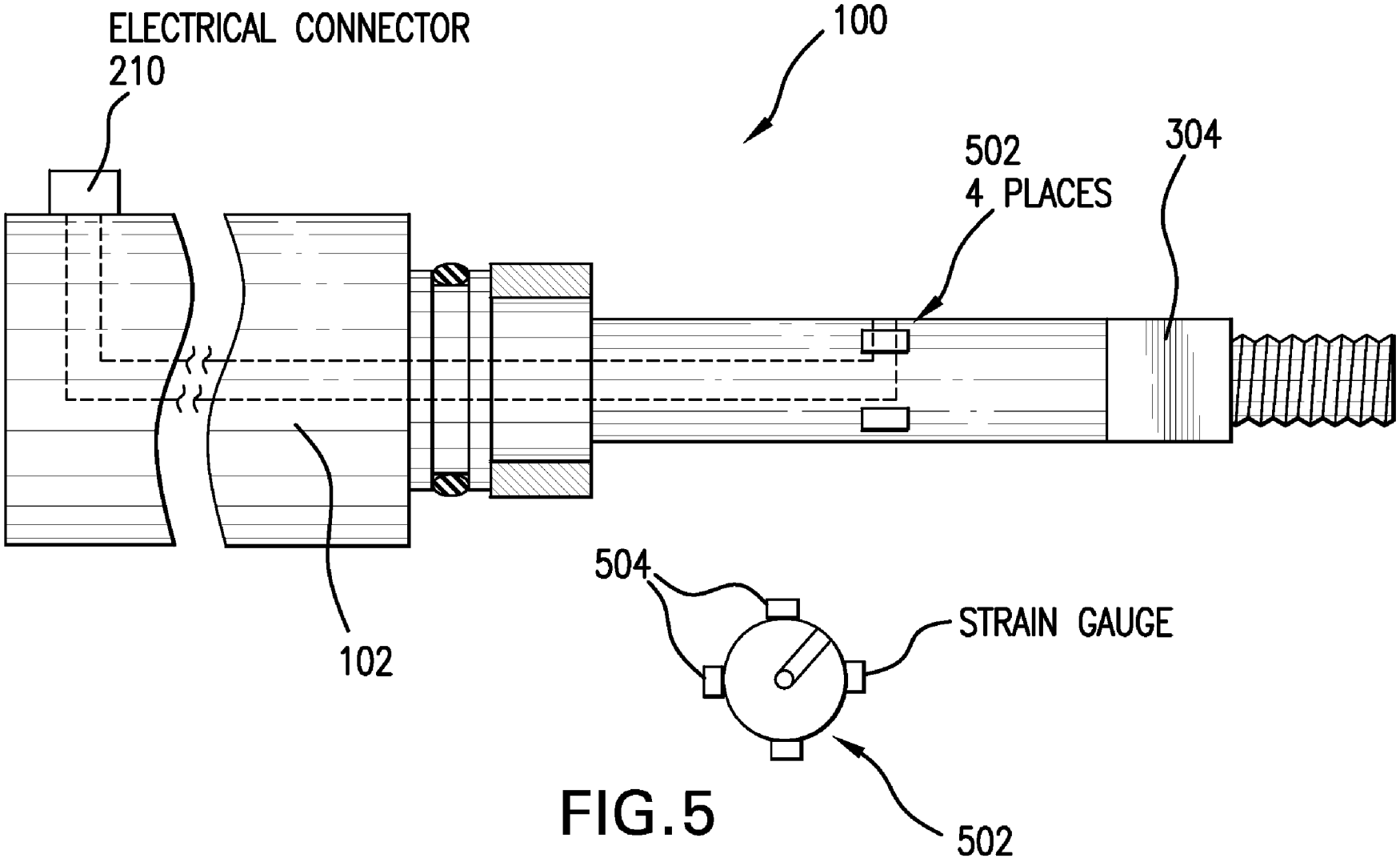
FIG. 5 is a schematic view of the apparatus according to one or more aspects of the present disclosure.

Referring to FIG. 5, illustrated is an exemplary embodiment of the RTTS tool 100 that employs one or more strain gauges 502 to measure applied torque. The one or more strain gauges 502 may be coupled to the shaft of the torque rod 102 at a predetermined distance from the end 304. In an exemplary embodiment, the one or more strain gauges 502 are coupled to the shaft by means of a suitable adhesive, such as cyanoacrylate or epoxy. The one or more strain gauges 502 may comprise a series of load cells 504. For example, through the mechanical arrangement, the force being sensed by the load cells 504 deforms the one or more strain gauges 502, which then converts the deformation (strain) to electrical signals that are transmitted to the electrical connector 210. In another embodiment, the one or more strain gauges 502 may comprise an equivalent electronic device (transducer) designed to relay the changing electrical resistance of a material due to applied mechanical stress, for example, piezoresistors.

Figure 6:
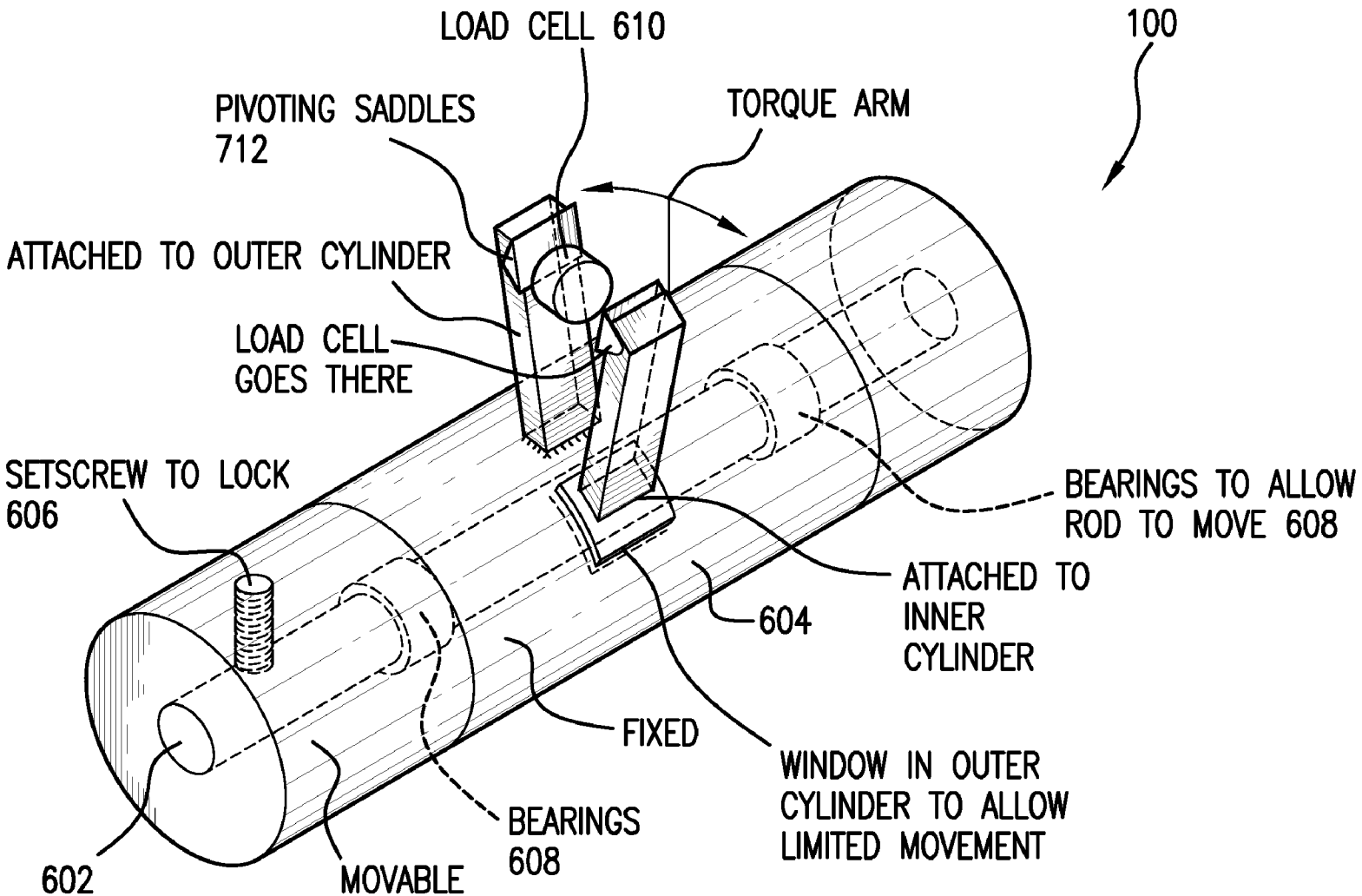
FIG. 6 is a perspective view of apparatus according to one or more aspects of the present disclosure.
Figure 7:
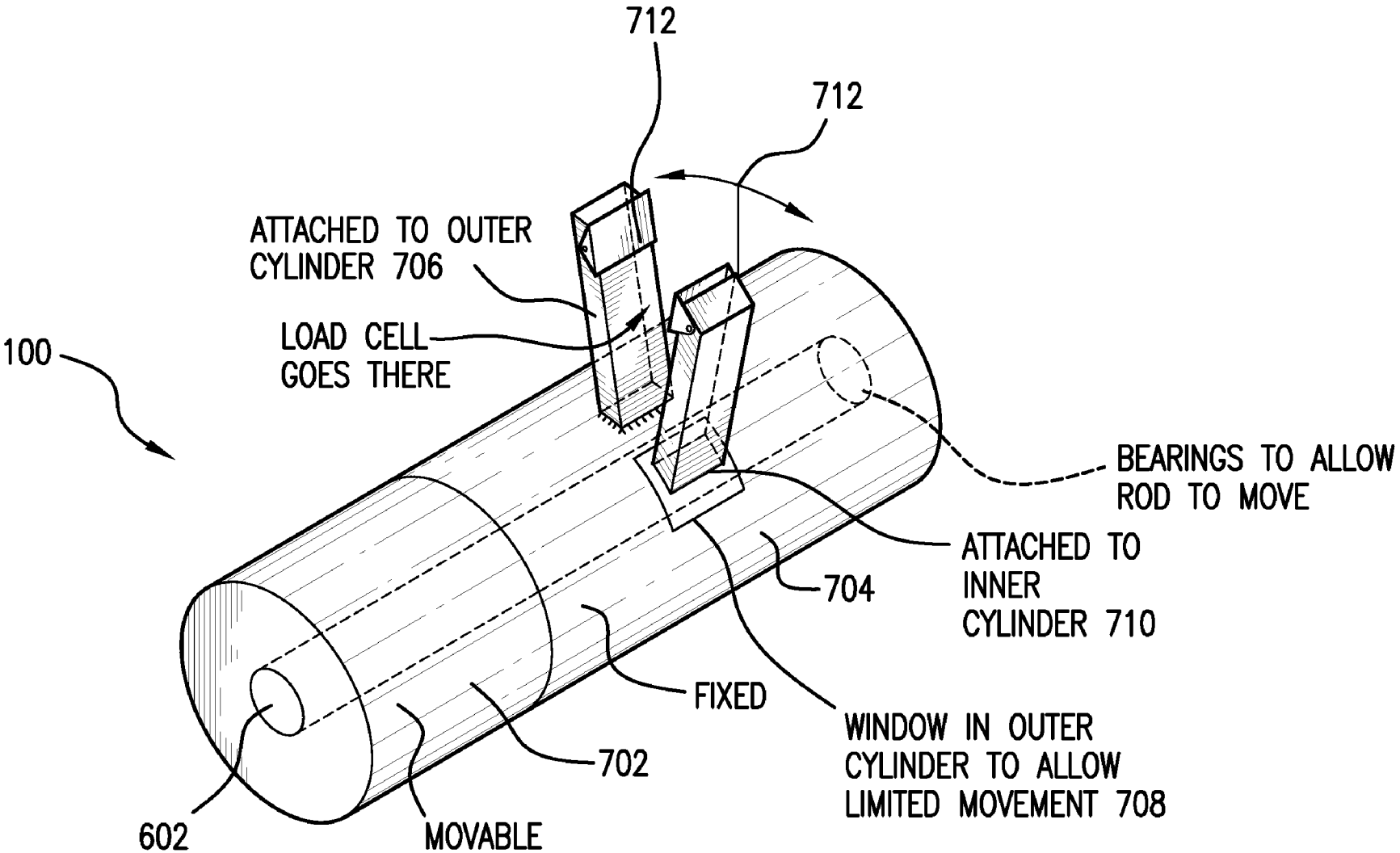
FIG. 7 is another perspective view of the apparatus shown in FIG. 6.

FIGS. 6 and 7 depict an exemplary embodiment of the RTTS 100 that may be useful for calibration purposes. In the embodiment shown in FIGS. 6 and 7, the RTTS 100 comprises a torque rod 602 threaded into a torque cylinder 604. A set screw 606 may be threaded through the torque cylinder 604 at one end, and may be designed to lock the torque rod 602 into place and prevent its axial movement. Bearings 608 may permit constrained relative motion (i.e., opposite, axial rotation) between the torque rod 602 and the torque cylinder 604.

As further illustrated in FIG. 7, the torque cylinder 604 may comprise a moveable portion 702 and a fixed portion 704. The fixed portion 704 may include a torque arm 706 that extends perpendicularly from its surface, as well as an aperture 708 that exposes the torque rod 602. In an exemplary embodiment, an adjacent torque arm 710 is coupled to the torque rod 702 and extends perpendicularly through the aperture 708. The torque arms 706, 710 may be configured to receive a load cell 610 (shown in FIG. 6). The load cell 610 is configured to seat betwixt the torque arms 706, 710 and attached to at least one pivoting saddle 712. In an exemplary embodiment, the load cell 610 is attached to a torque arm 706, 710 by means of a suitable adhesive, such as cyanoacrylate or epoxy. The pivoting saddles 712 are hinged to the torque arms 706, 710 and allow a load cell 610 to seat on one torque arm and move relative to the second torque arm during torque measurement.

Apparatus within the scope of the present disclosure may enable the dimensional mimicry of the items of interest while those items are positioned within grappling devices that apply the torque. Connection adapters of various dimensions or threads may mimic the size and configuration of the objects of interest such that the RTTS will experience the same loads as the production devices withstand.

Figure 8:
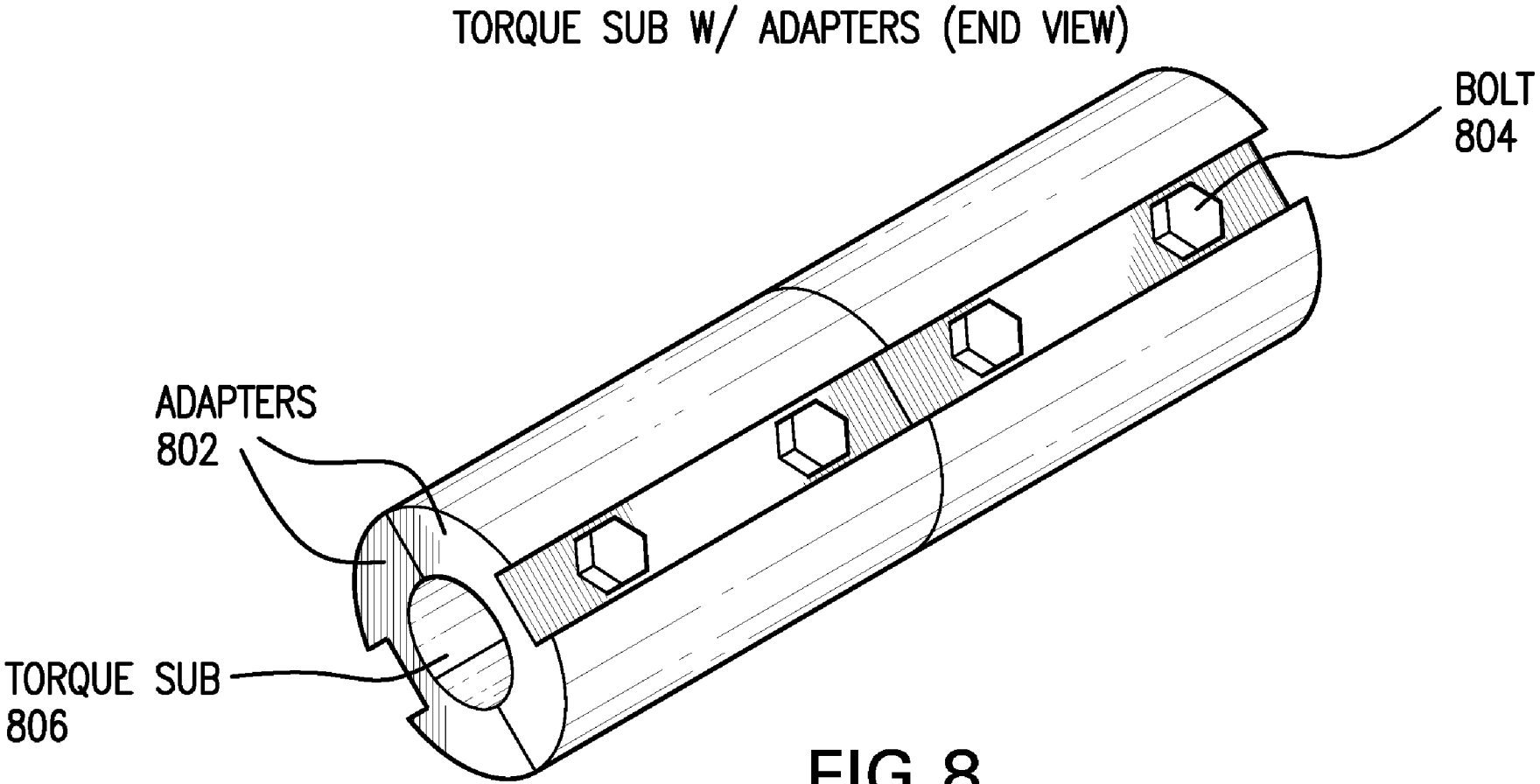
FIG. 8 is a perspective view of the apparatus according to one or more aspects of the present disclosure.
Figure 9:
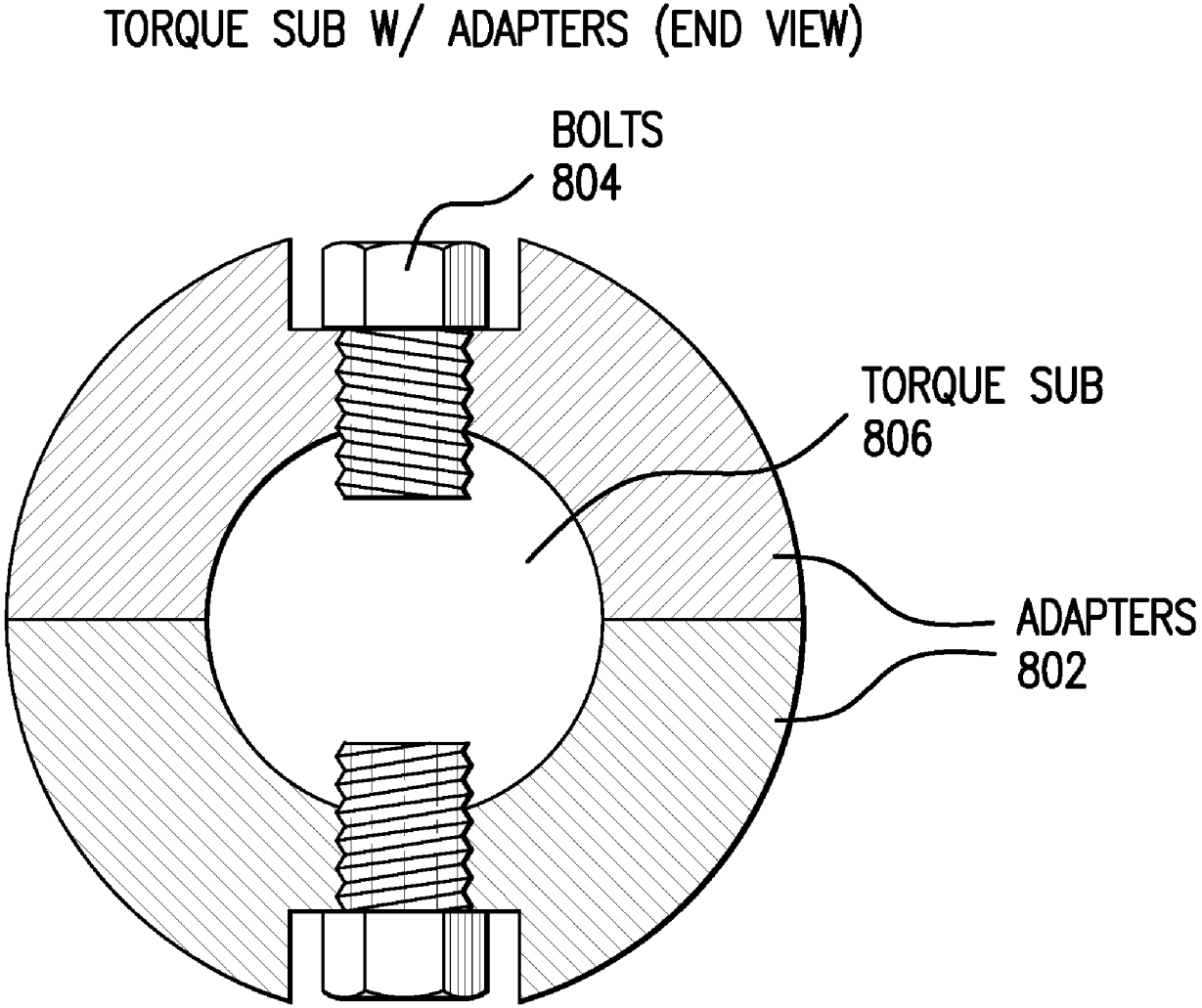
FIG. 9 is a cross-sectional end view of the apparatus shown in FIG. 8.

FIGS. 8 and 9 illustrate an exemplary embodiment of connection adapters 802 that may be configured to couple to individual tubular members and a torque sub 806. A tool set may involve two torque subs 806 and two sets of connection adapters 802 to provide a level of redundancy required by operators. In an exemplary embodiment, the connection adapters 802 are sleeves whose diameters mimic the dimension of the tubulars being assembled. The torque subs 806 may be available in various sizes according to the torque being measured. Multiple sizes are required as there are torque limitations within a single envelope; i.e., the torque sub made for 2⅜" tubing is not expected to have the torque measurement capacity required for 9⅝" casing.

In an exemplary embodiment, using a series of bolts 804, the connection adapters 802 may be first coupled to the torque sub 806, which houses the RTTS tool. The connection adapters 802 may also be coupled to individual tubular members at opposing ends.

Figure 10:
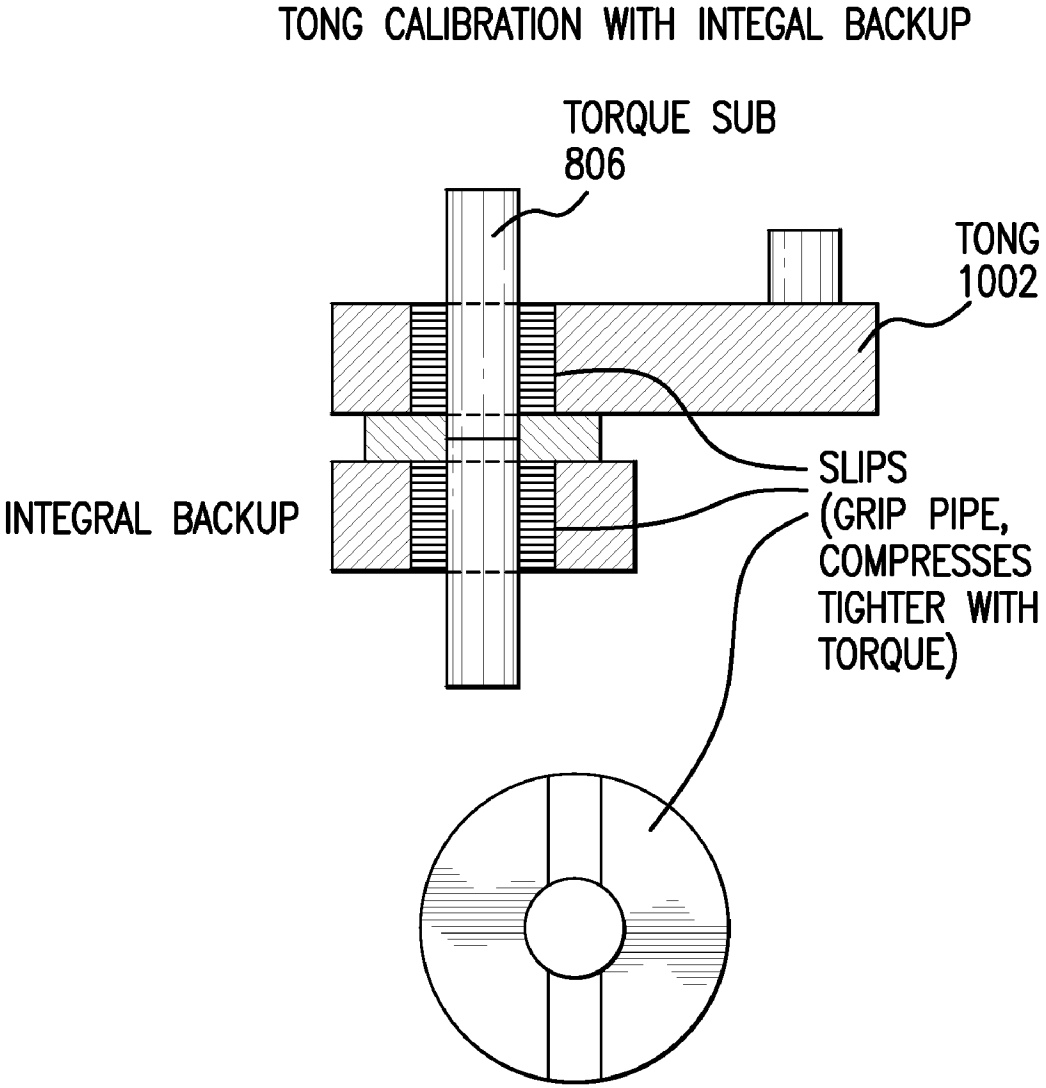
FIG. 10 is a schematic view of the apparatus according to one or more aspects of the present disclosure.
Figure 11:
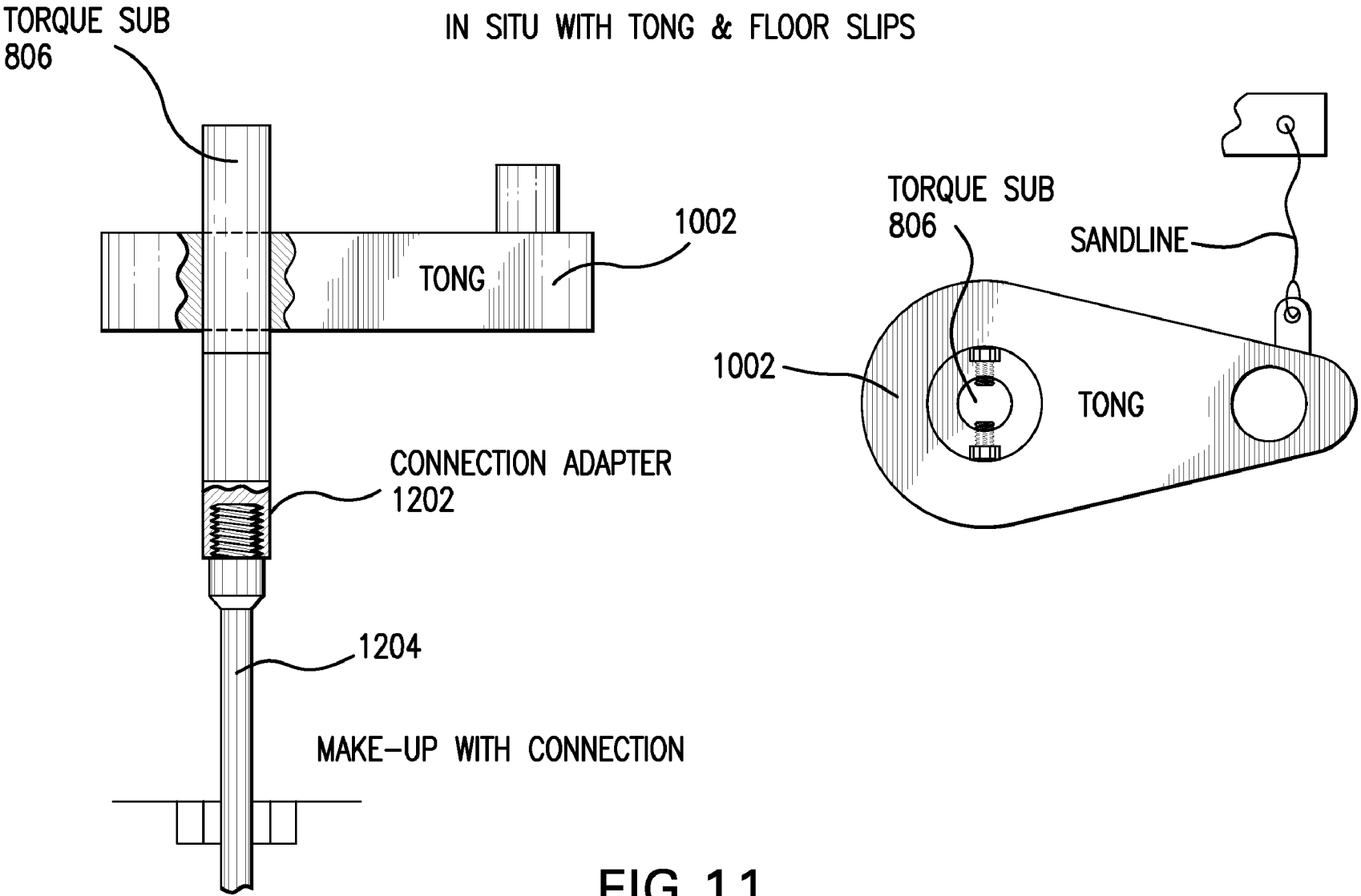
FIG. 11 is a schematic view of the apparatus according to one or more aspects of the present disclosure.

FIG. 10 illustrates the torque sub 806 in conjunction with working tongs 1002. The torque sub 806, which houses the RTTS tool for measuring torque, is gripped by the tong 1002 on one end and gripped by an integral backup 1004 on its other end. The integral backup 1004 serves as a slip that is designed to compress tighter with increasing torque. The gripped torque sub 806 permits the RTTS tool to measure the torque being applied by the tongs 1002. In an alternative embodiment, FIG. 11 depicts the tong 1002 in gripping connection with the torque sub 806 in the process of making-up a tubular connection. As described in further detail in FIG. 12 below, a connection adapter 1202 may be employed at one end of the torque sub 806 to threadably couple to a tubular 1204.

Figure 12:
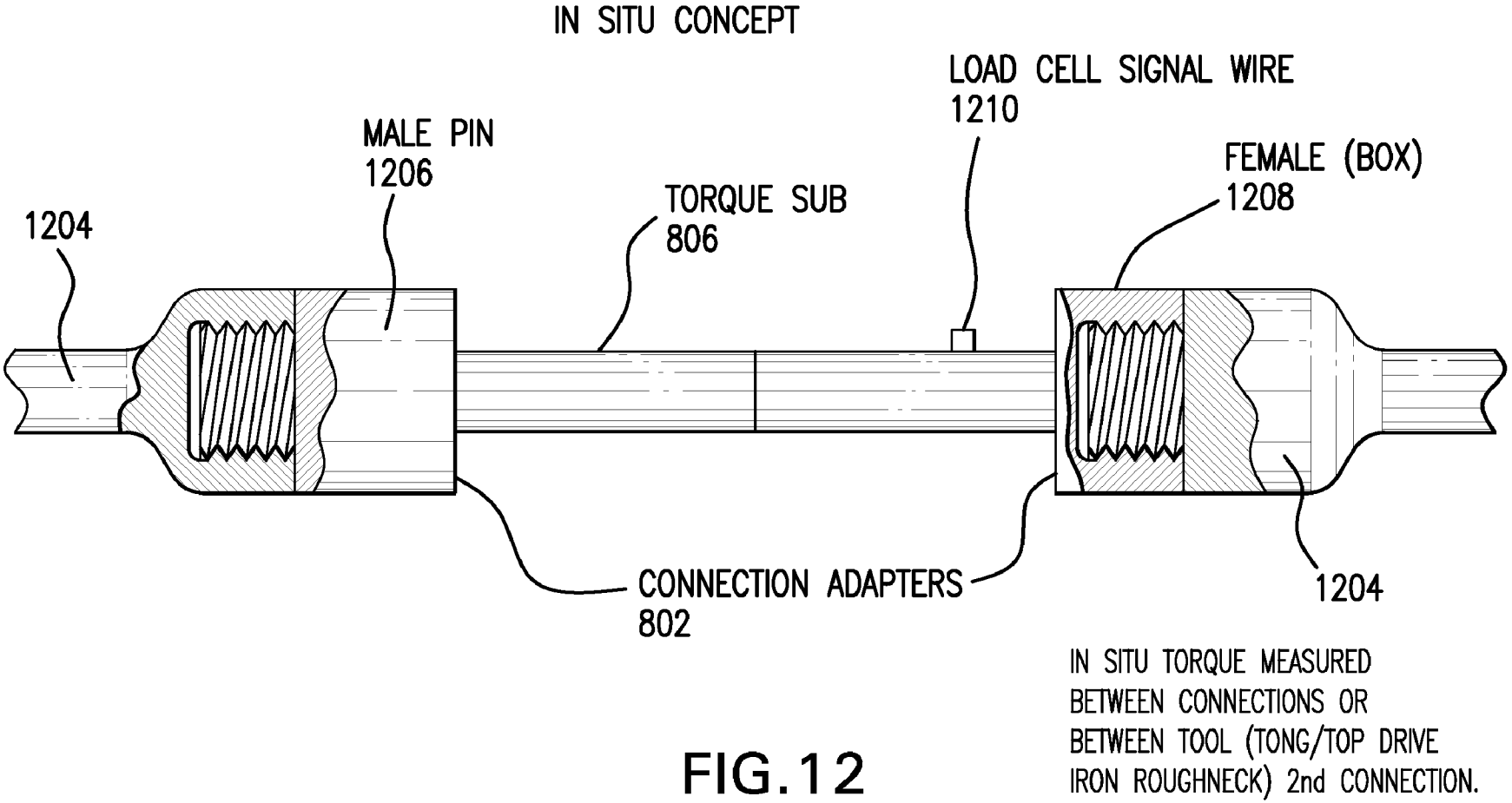
FIG. 12 is a schematic view of the apparatus according to one or more aspects of the present disclosure.

As depicted in FIG. 12, a connection adapter 802 may comprise a male-threaded pin 1206 that is capable of threadably coupling to the inside (box end) of a tubular member 1204. A connection adapter 1202 may also comprise a female-threaded box 1208 that is capable of threadably coupling to the outside (pin end) of a tubular member 1204. FIG. 12 further illustrates an exemplary location for a load cell signal wire or connector 1210 stemming from the torque sub 806.

Figure 13:
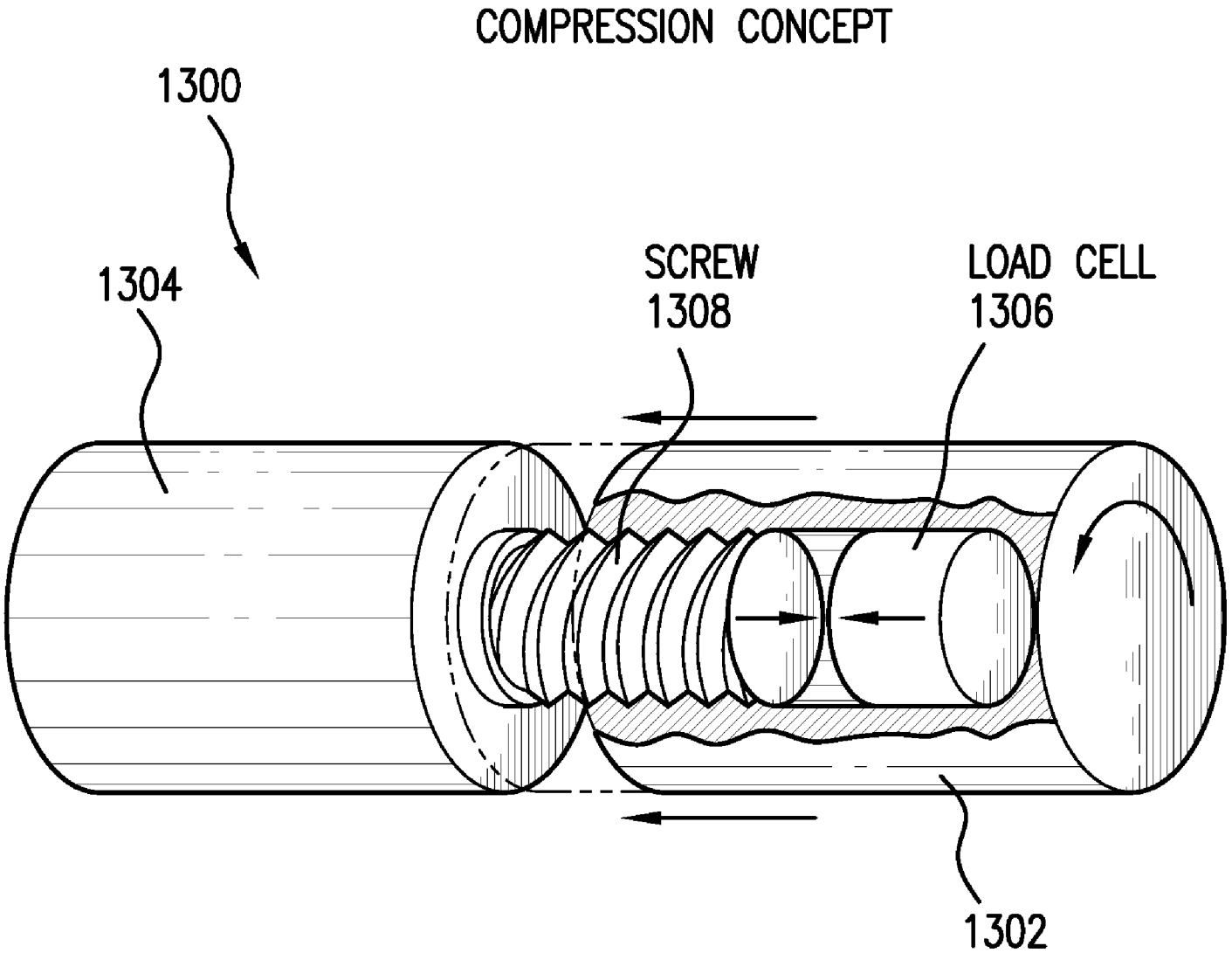
FIG. 13 is a schematic view of the apparatus according to one or more aspects of the present disclosure.
Figure 14:
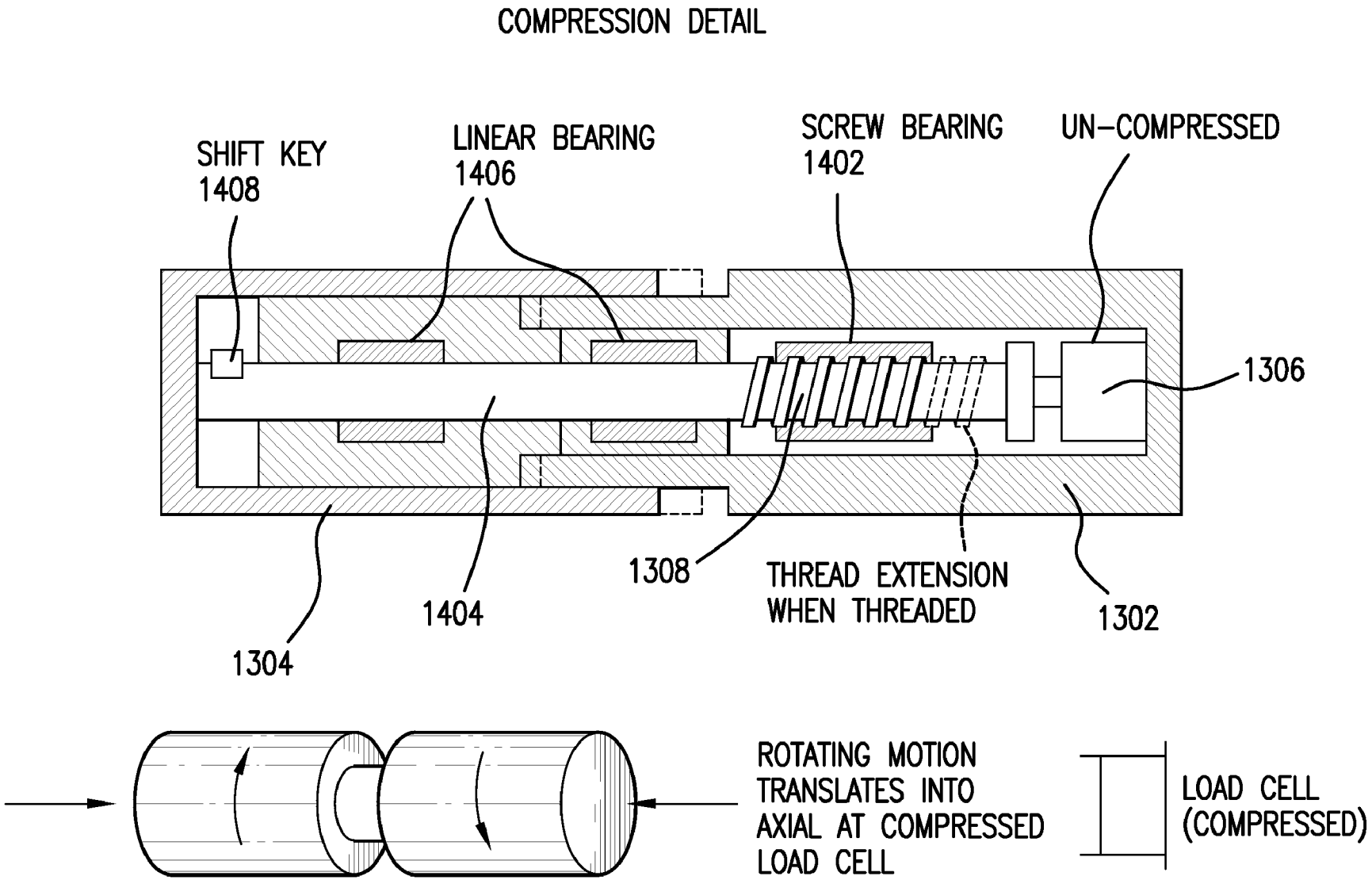
FIG. 14 is a cross-sectional side view of the apparatus shown in FIG. 13.

FIGS. 13 and 14 illustrate an exemplary embodiment of the RTTS tool 100, designated herein by reference numeral 1300. In this embodiment, the RTTS tool 1300 comprises two cylindrical portions 1302, 1304 that are each capable of individual axial rotation that results in a readable compressive force. A load cell 1306 may be seated in the cylindrical portion 1302 and is configured to be compressed by a screw 1308 that translates rotating motion into axial motion. Screw 1308 rotates along a screw bearing 1402 configured to axially move the screw 1308 longitudinally towards or away from the load cell 1306. The compressive force against the load cell 1306 is then converted into an electrical signal and translated into torque. The shaft 1404 of the screw 1308 is further supported by linear bearings 1406 and partially located in cylindrical portion 1304 where it further comprises a shift key 1408 designed to prevent excessive movement of the screw 1308 in the opposite direction.

Figure 15:
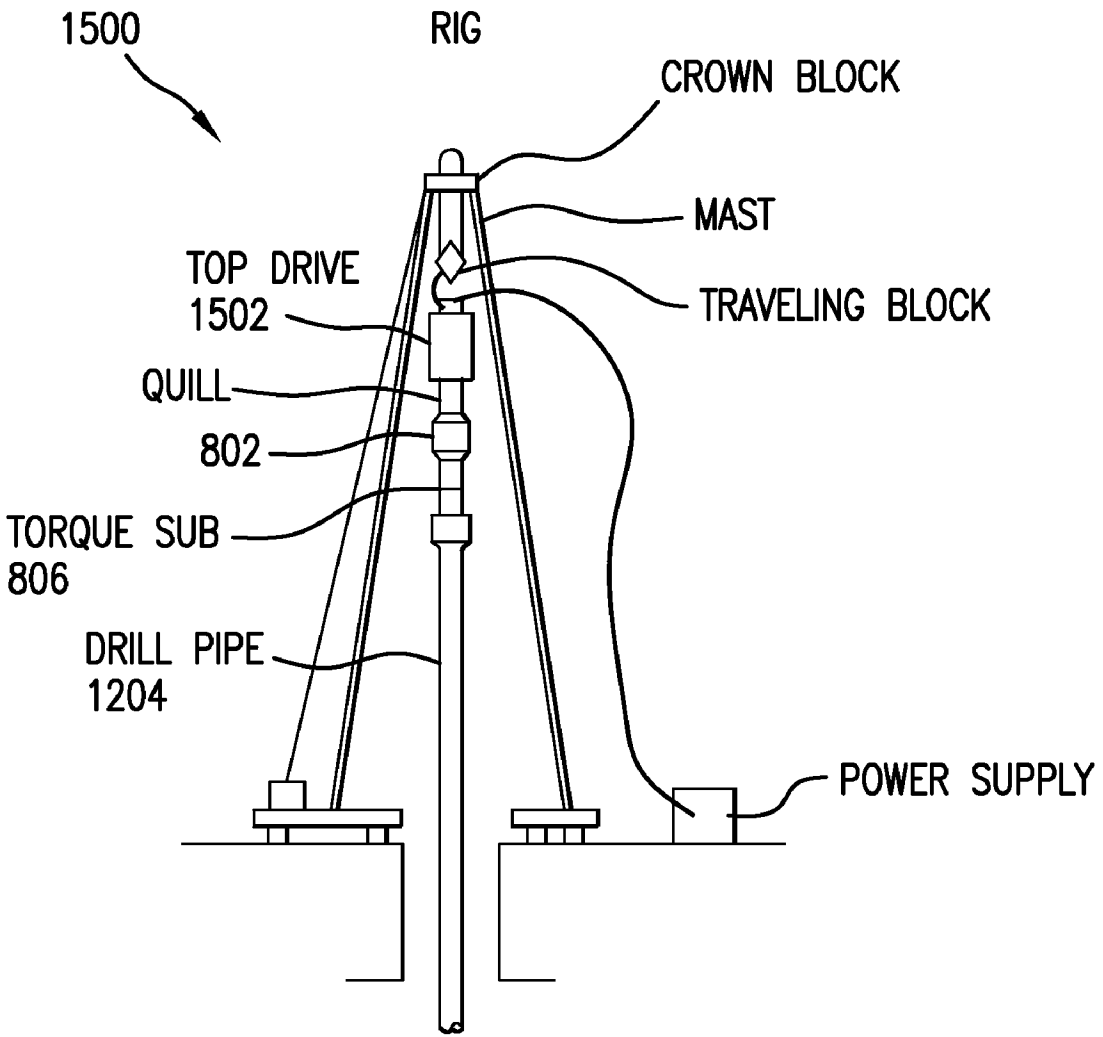
FIG. 15 is a schematic view of the apparatus according to one or more aspects of the present disclosure.

FIG. 15 depicts an exemplary schematic embodiment of a drilling rig 1500 that may employ a RTTS tool to measure applied torque according to one or more aspects of the present disclosure. In this example, the torque sub 806 that houses the RTTS tool is coupled to the adapter 802 which is ultimately driven by the top drive 1502. The measured torque results from the amount of force needed to connect to the drill pipe 1204. This implementation allows for the real time monitoring of actual torque provided by a drive 1502 above the rig surface.

Figure 16:
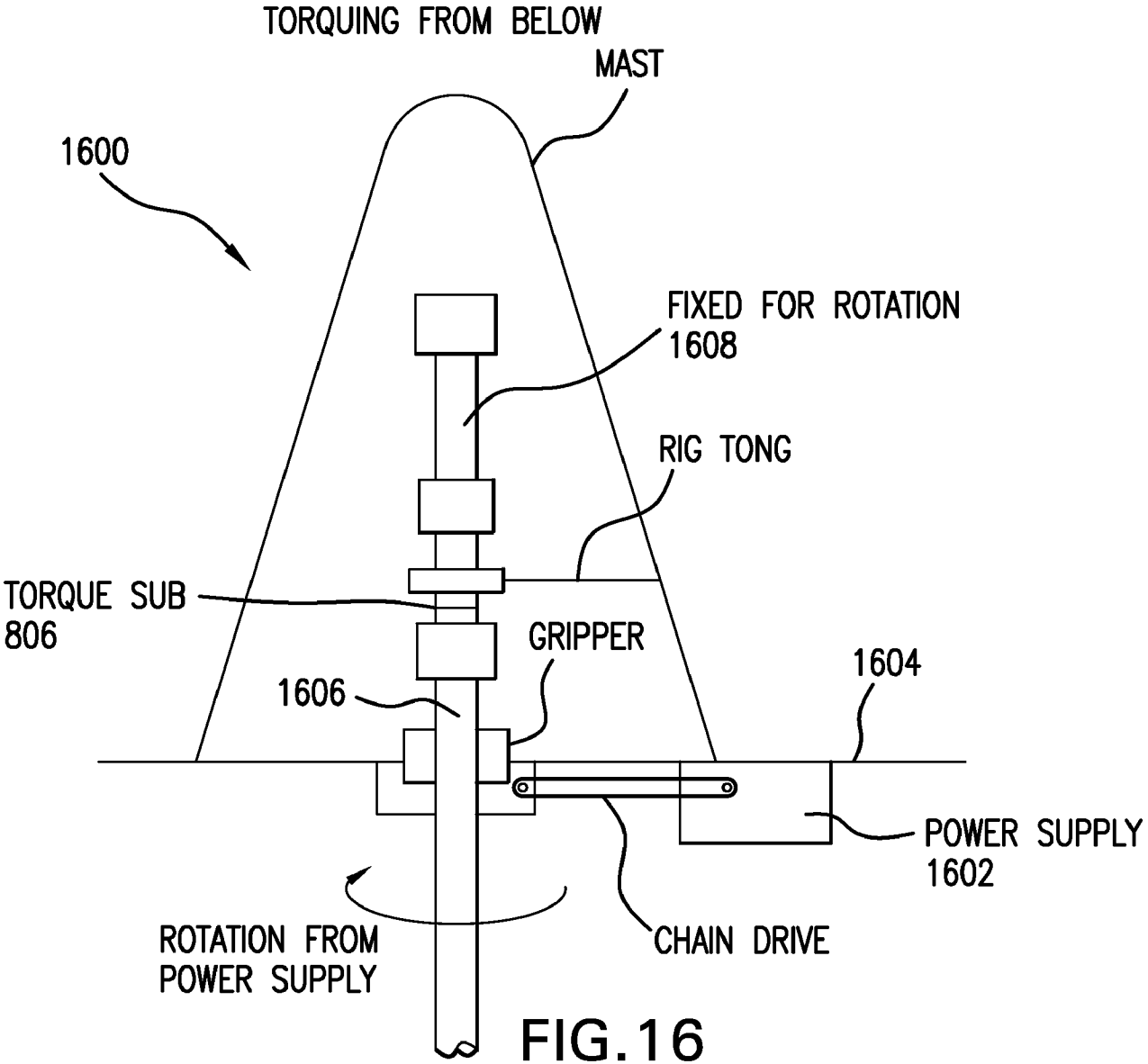
FIG. 16 is a schematic view of the apparatus according to one or more aspects of the present disclosure.

In an alternative embodiment, FIG. 16 illustrates the real time monitoring of actual torque provided by a drive 1602 below the rig floor 1604. The drilling rig 1600 employs a torque sub 806 that is connected to tubular segments 1604, 1606 and houses a RTTS tool. Tubular 1608 is fixed for rotation while tubular 1606 is axially rotated. The resulting torque is measured at the torque sub 806 and transmitted, for example, to the rig operator.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be coupled through some interface or device, such that the items may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

What is claimed is:

1. An apparatus, comprising:

a torque cylinder having a first end and a second end;

a torque rod at least partially contained in the torque cylinder and coupled to the first end of the torque cylinder, wherein the torque rod extends longitudinally outward from the second end of the torque cylinder; and a strain gauge connected to the torque rod and configured to measure in-situ the applied torque between two tubular drill string segments each coupled to a respective one of the torque cylinder and the torque rod.

2. The apparatus of claim 1 wherein a gap is maintained between the torque cylinder and the torque rod.

3. The apparatus of claim 2 wherein the gap is radially disposed between longitudinally adjacent portions of the torque cylinder and the torque rod so as to permit opposite axial rotation therebetween.

4. The apparatus of claim 1 wherein the torque rod is cylindrical in shape.

5. The apparatus of claim 1 further comprising an electrical connector attached to an outer surface of the torque rod.

6. The apparatus of claim 5 wherein the electrical connector transmits torque data in real-time.

7. The apparatus of claim 1 further comprising at least one load cell configured to convert a force into an electrical signal.

8. The apparatus of claim 1 further comprising a plurality of connection adapters each configured to connect one of the torque rod and the torque cylinder to one of the two tubular drill string segments.

9. The apparatus of claim 1, wherein the strain gauge is connected via an adhesive component.

10. The apparatus of claim 1, wherein the torque rod is constrained to rotational motion relative to the torque cylinder.

11. The apparatus of claim 10, wherein a plurality of bearings constrains the motion.

12. The apparatus of claim 11, wherein an O-ring is concentrically disposed between the torque rod and the torque cylinder to prevent fluid flow to a cavity between the torque rod and the torque cylinder.

13. An apparatus, comprising:

a torque cylinder having a torque rod extending axially longitudinally therethrough, wherein the torque rod is constrained to rotational motion by a plurality of bearings, and wherein the torque cylinder defines an aperture;

a first torque arm coupled to the torque cylinder and extending radially outward from the torque cylinder;

a second torque arm coupled to the torque rod and extending radially outward through the aperture; and a load cell configured to attach to the first torque arm and measure applied torque when the second torque arm is forced into compressive contact therewith.

14. The apparatus of claim 13 wherein the torque cylinder comprises a set screw configured to prevent axial movement of the torque rod.

15. The apparatus of claim 13 wherein the load cell is a piezoresisitive transducer.

16. The apparatus of claim 13 wherein the first and second torque arms each comprise a pivoting saddle configured to seat the load cell on the first torque arm and move relative to the second torque arm.

17. The apparatus of claim 13, wherein the load cell is attached to the first torque arm with an adhesive component.

* * * * *